US010358685B2

(12) United States Patent
Sun et al.

(10) Patent No.: US 10,358,685 B2
(45) Date of Patent: Jul. 23, 2019

(54) SUGAR EXTRACTION AND IONIC LIQUID RECYCLING USING ALKALINE SOLUTIONS

(71) Applicants: THE REGENTS OF THE UNIVERSITY OF CALIFORNIA, Oakland, CA (US); SANDIA CORPORATION, Livermore, CA (US)

(72) Inventors: Ning Sun, Fremont, CA (US); Bradley M. Holmes, Oakland, CA (US); Kim Tran, Richmond, CA (US); Anthe George, San Francisco, CA (US); Blake Simmons, San Francisco, CA (US)

(73) Assignees: The Regents of the University of California, Oakland, CA (US); National Technology & Engineering Solutions of Sandia, LLC, Albuquerque, NM (US)

( * ) Notice: Subject to any disclaimer, the term of this patent is extended or adjusted under 35 U.S.C. 154(b) by 0 days.

(21) Appl. No.: 14/398,432

(22) PCT Filed: May 2, 2013

(86) PCT No.: PCT/US2013/039194
§ 371 (c)(1),
(2) Date: Oct. 31, 2014

(87) PCT Pub. No.: WO2013/166237
PCT Pub. Date: Nov. 7, 2013

(65) Prior Publication Data

US 2015/0122246 A1 May 7, 2015

Related U.S. Application Data

(60) Provisional application No. 61/641,834, filed on May 2, 2012.

(51) Int. Cl.
*C13K 1/02* (2006.01)
*C13K 1/04* (2006.01)
*C13K 13/00* (2006.01)

(52) U.S. Cl.
CPC ..... *C13K 1/02* (2013.01); *C13K 1/04* (2013.01); *C13K 13/002* (2013.01)

(58) Field of Classification Search
None
See application file for complete search history.

(56) References Cited

U.S. PATENT DOCUMENTS 3,532,596 A * 10/1970 Bills ..... D21C 3/222 162/70
2004/0173533 A1* 9/2004 Farone ..... B01D 15/362 210/656

(Continued)

FOREIGN PATENT DOCUMENTS

WO WO 2010/043424 * 4/2010
WO WO 2010/067785 * 6/2010

(Continued)

OTHER PUBLICATIONS

Efficient Acid-Catalyzed Hydrolysis of Cellulose in Ionic Liquid Changzhi Li and Zongbao K. Zhao Adv. Synth. Catal. vol. 349, pp. 1847+1850 (Year: 2007).*

(Continued)

*Primary Examiner* — Douglas B Call
(74) *Attorney, Agent, or Firm* — Kilpatrick Townsend & Stockton LLP

(57) ABSTRACT

The present invention provides a method for obtaining a monosaccharide from a lignocellulosic material in a form suitable for use as a carbon source in a reaction. In some (Continued)

embodiments, the monosaccharide is in a form suitable for use in a fermentation reaction, e.g., to produce an alcohol such as ethanol.

25 Claims, 6 Drawing Sheets

(56) References Cited

U.S. PATENT DOCUMENTS

| | | | | |
|---|---|---|---|---|
| 2009/0056707 | A1 | 3/2009 | Foody et al. | |
| 2009/0198046 | A1 | 8/2009 | Fanselow et al. | |
| 2010/0196967 | A1 | 8/2010 | Edye et al. | |
| 2011/0201096 | A1* | 8/2011 | Streffer | C08H 8/00 435/277 |
| 2011/0250637 | A1* | 10/2011 | Kurihara | B01D 61/022 435/41 |
| 2012/0301948 | A1* | 11/2012 | Brennan | C07H 1/08 435/243 |

FOREIGN PATENT DOCUMENTS

| | | | |
|---|---|---|---|
| WO | 2011/041455 | A1 | 4/2011 |
| WO | WO 2011/041455 | * | 4/2011 |

OTHER PUBLICATIONS

International Search Report and Written Opinion dated Oct. 4, 2013 of International Patent Application No. PCT/US2013/039194, 10 pages.

Binder et al., "Fermentable sugars by chemical hydrolysis of biomass", *PNAS*, vol. 107, No. 10, pp. 4516-4521 (2010).

Aziz et al., "Process optimization studies on solvent extraction with naphthalene-2-boronic acid ion-pairing with trioctylmethylammonium chloride i sugar purification using design of experiments," Separatation and Purification Technology 60 (2008) 190-197.

Gutowski, et al., "Controlling the Aqueous Miscibility of Ionic Liquids: Aqueous Biphasic Systems of Water-Miscible Ionic Liquids and Water-Structuring Salts for Recycle, Metathesis, and Separations," J. Am. Chem. Soc. vol. 125, pp. 6632-6633 (2003).

Li, et al., "Partitioning of Cephalexin in Ionic Liquid Aqueous Two-Phase System Composed of 1-Butyl-3-Methylimidazolium Tetrafluoroborate and $ZnSO_4$," Journal of Chemistry vol. 2013, 5 pages (2012).

Bridges, et al., "Investigation of aqueous biphasic systems formed from solutions of chaotropic salts with kosmotropic salts (salt-salt ABS)," Green Chem. vol. 9, pp. 177-183 (2007).

Wu, et al., "Phase Behavior for Ternary Systems Composed of Ionic Liquid+Saccharides+Water," J. Phys. Chem. B vol. 112, pp. 6426-6429 (2008).

Neves, et al., "Evaluation of Cation Influence on the Formation and Extraction Capability of Ionic-Liquid-Based Aqueous Biphasic Systems," J. Phys. Chem. B vol. 113, pp. 5194-5199 (2009).

Li, et al., "Ionic liquid-based aqueous two-phase system, a sample pretreatment procedure prior to high-performance liquid chromatography of opium alkaloids," Journal of Chromatography B vol. 826, pp. 58-62 (2005).

Li, et al., "Ionic liquid-based aqueous two-phase systems and their applications in green separation processes," Trends in Analytical Chemistry, vol. 29, No. 11 pp. 1336-1346 (2010).

* cited by examiner (a)

(b)

SUGAR EXTRACTION AND IONIC LIQUID RECYCLING USING ALKALINE SOLUTIONS

CROSS-REFERENCES TO RELATED APPLICATIONS

This application is a National Stage of International Application No. PCT/US2013/039194, filed May 2, 2013, and which claims the benefit of U.S. provisional application No. 61/641,834, filed May 2, 2012, which is herein incorporated by reference for all purposes.

STATEMENT AS TO RIGHTS TO INVENTIONS MADE UNDER FEDERALLY SPONSORED RESEARCH AND DEVELOPMENT

The invention described and claimed herein was made utilizing funds supplied by the U.S. Department of Energy under Contract No. DE-AC02-05CH11231. The government has certain rights in this invention.

BACKGROUND OF THE INVENTION

Lignocellulosic materials are the most abundant renewable resources that have great potential for production of scalable fuels and chemicals. Extensive attention has been attracted to convert cellulosic biomass to valuable products usually through two step processes: 1) hydrolyze the biomass to sugar monomers; 2) convert sugars into bio-based products (Huber el al. *Chem. Rev.,* 2006, 106, 4044-4098; Zhu et al. *Green. Chem.,* 2006, 8, 325-327). The full potential of the biopolymers has not been fully exploited mainly due to the historical shift towards petroleum-based feedstocks from the 1940s and the recalcitrant nature of biomass, which holds back a cost efficient technology to convert lignocellulosic biomass to sugars (Sun et al. *Chem. Commun.,* 2011, 47, 1405-1421). The use of ionic liquids (ILs) as biomass solvents is considered to be an attractive alternative for the pretreatment of lignocellulosic biomass (Mora-Pale et al. *Biotechnol. Bioeng.* 2011, 108, 1229-1245). It has been shown that pretreatment with imidazolium based ILs, containing anions such as chloride (Li et al. *Ind. Eng. Chem. Res.,* 2010, 49, 2477-2484), acetate (Li et al. *Bioresour. Technol.,* 2010, 101, 4900-4906) and alkyl phosphate (Brandt et al. *Green Chem.* 2010, 12(4), 672-679), can greatly accelerate the enzymatic digestion of the pretreated biomass that has been completely or partially solubilized in the IL. Current approaches that use 100% IL as the pretreatment medium require large amount of water to wash out the residue IL in the pretreated biomass and usually the IL is diluted down to below 10%. Thus the conventional IL pretreatment process must also have effective means of recovering and recycling the IL to be cost competitive.

Acid catalysis has been used to produce sugars and other high value compounds in situ through the acid catalyzed hydrolysis of biomass dissolved in imidazolium chloride ILs (Li et al. *Green Chem.,* 2008, 10, 177-182; Rinaldi et al. *Angew. Chem.,* 2008, 47, 8047-8050; Vanoye et al. *Green Chem.,* 2009, 11, 390-396; Sievers et al. *Ind. Eng. Chem. Res.,* 2009, 48, 1277-1286). Li et al reported biomass hydrolysis in ILs with different mineral acids as catalyst and up to 68% total reducing sugars were achieved with the combination of $[C_4mim]Cl$ and hydrochloric acid (Li et al. *Green Chem,* 2008, 10, 177-182). The use of Brønsted acidic ILs to dissolve and hydrolyze cellulose was also reported, where the ILs act as both the solvent and catalyst (Amarasekara et al. *Ind. Eng. Chem. Res.,* 2009, 48, 10152-10155). This could potentially provide a means of liberating fermentable sugars from biomass without the use of costly enzymes. However, the separation of the sugars from the aqueous IL and recovery of IL is challenging and imperative to make this process viable.

Rogers et al reported for the first time that some hydrophilic ILs could form aqueous biphasic system (ABS) in the presence of concentrated kosmotropic salts (Gutowski et al. *J. Am. Chem. Soc.* 2003, 125, 6632). Since then, significant progress has been made in this field (He et al. *J. Chromatogr.*, A 1082 (2005) 143; Bridges el al. *Green Chem* 9 (2007) 177; Wu et al. *J. Phys. Chem.* B 112 (2008) 6426; Neves et al. *J. Phys. Chem.* B 113 (2009) 5194). It has been reported that IL based ABS can be formed with addition of appropriate amount of $K_3PO_4$, $K_2HPO_4$, $K_2CO_3$, KOH, NaOH, or $Na_2HPO_4$ into aqueous $[C_4mim]Cl$ (He et al. *J. Chromatogr., A* 1082 (2005) 143; Bridges et al. *Green Chem* 9 (2007) 177; Li et al. *J. Chromatogr.*, B 826 (2005) 58). When these kosmotropic ions (anions of the salts) were added into aqueous IL solutions, the hydrogen-bond network of water was enhanced because of their water structuring nature. Therefore, more energy was required for cavity formation around the bulky organic $[C_4mim]^+$ cation. At a certain concentration of kosmotropic salts, an aqueous phase containing IL with more hydrophobic cation and less water-structuring anion was separated (Li el al. *J. Wang Trend Anal Chem,* 2010, 29, 1336-1346).

The present invention provides a process to utilize IL phase separation behavior to efficiently extract sugars from aqueous ILs. Surprisingly, sugar and IL recovery can be realized in a single step.

BRIEF SUMMARY OF THE INVENTION

In one embodiment, the present invention provides a method for obtaining a monosaccharide from a lignocellulosic material, the method including contacting a lignocellulosic material with an ionic liquid to form a solution of the lignocellulosic material in the ionic liquid; adding an aqueous acidic solution to the solution of the lignocellulosic material in the ionic liquid to form an aqueous solution of sugar monomers and the ionic liquid; contacting the aqueous solution of sugar monomers and the ionic liquid with an aqueous alkaline solution to form a biphasic system which comprises an ionic liquid phase essentially free of sugar monomers and a second liquid phase comprising a monosaccharide; separating the ionic liquid phase and the second liquid phase; and recovering the second liquid phase comprising the monosaccharide. In some embodiments of the methods of the invention, the second liquid phase comprising the monosaccharide may be subjected to further treatment, e.g., neutralization and/or desalination.

In another embodiment, the present invention provides a method for obtaining a monosaccharide from a lignocellulosic material, the method including contacting a lignocellulosic material with an ionic liquid to form a solution of the lignocellulosic material in the ionic liquid; adding an aqueous acidic solution to the solution of the lignocellulosic material in the ionic liquid to form an aqueous solution of sugar monomers and the ionic liquid; contacting the aqueous solution of sugar monomers and the ionic liquid with an aqueous alkaline solution to form a biphasic system which comprises an ionic liquid phase essentially free of sugar monomers and a second liquid phase comprising a monosaccharide; separating the ionic liquid phase and the second liquid phase; subjecting the second liquid phase to neutralization and desalination. In some embodiments, the method further comprises subjecting the neutralized, desalinized liquid phase to a fermentation reaction to ferment the monosaccharide.

In a further embodiment, the present invention provides a method for producing a fermentable monomeric sugar from a lignocellulosic material, the method including contacting a lignocellulosic material with an ionic liquid to form a solution of the lignocellulosic material in the ionic liquid; adding an aqueous acidic solution to the solution of the lignocellulosic material in the ionic liquid to form an aqueous solution of sugar monomers and the ionic liquid; contacting the aqueous solution of sugar monomers and the ionic liquid with an aqueous alkaline solution to form a biphasic system which comprises an ionic liquid phase essentially free of sugar monomers and a second liquid phase comprising a monosaccharide; separating the ionic liquid phase and the second liquid phase; and subjecting the second liquid phase to neutralization and desalination, thereby obtaining a fermentable monomeric sugar. In some embodiments, the method comprises subjecting the fermentable monomeric to a fermentation reaction, e.g., to produce an alcohol such as ethanol.

DETAILED DESCRIPTION OF THE INVENTION

Overview

Figure 1:
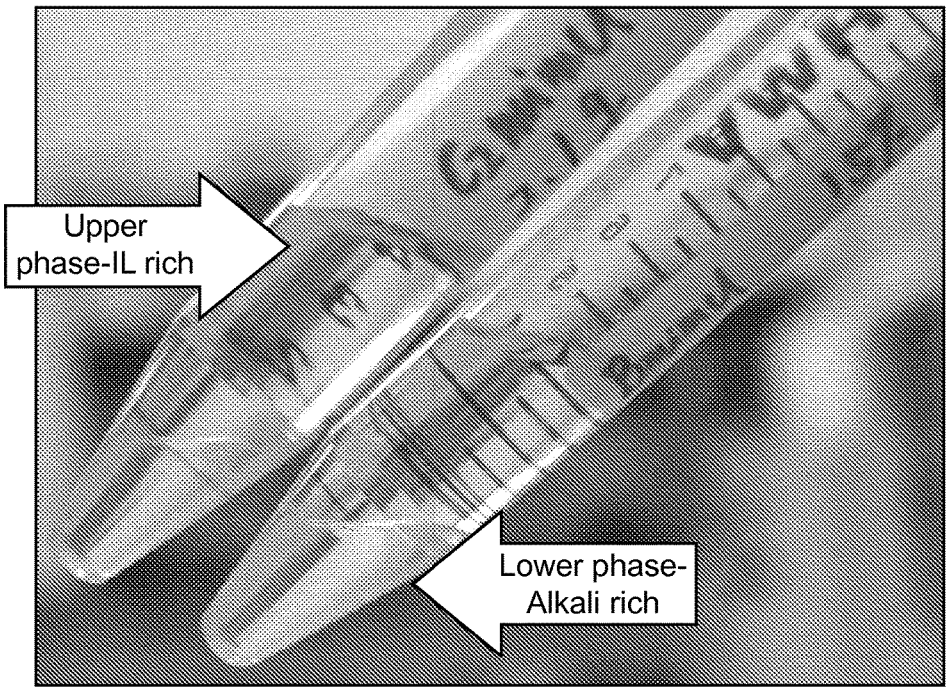
FIGS. 1*a* and 1*b* show phase separation with addition of 15% NaOH to the ionic liquids: (a) no biomass, 1-ethyl-3-methylimidazolium chloride ([$C_2$mim]Cl) used in the left tube, 1-butyl-3-methylimidazolium chloride ([$C_4$mim]Cl) used in the right tube, (b) after acidolysis of biomass.
Figure 1:
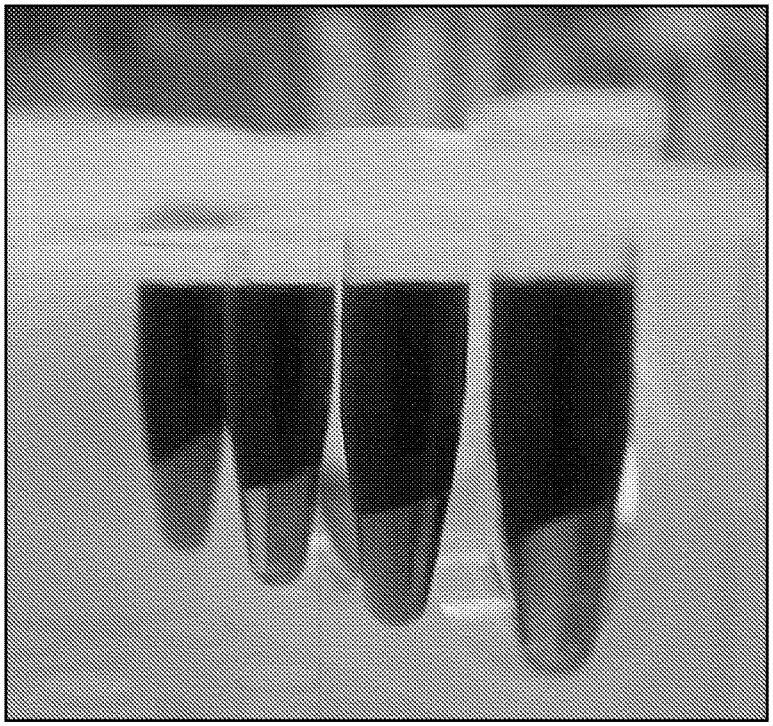

The present invention provides novel methods for obtaining a monosaccharide from a lignocellulosic material without the use of enzymes, such as cellulases. The methods of the present invention include solubilization of the lignocellulosic material in an ionic liquid and acidolysis followed by addition of an aqueous alkaline solution to form a biphasic solution, wherein the monosaccharide is extracted into the aqueous alkaline solution phase. Separation of the ionic liquid phase from the aqueous alkaline solution phase is convenient, and sugar recovery is efficient. In addition, the ionic liquid can be recovered and recycled for further use.

In some embodiments, the present invention provides a method for obtaining a fermentable monosaccharide from a lignocellulosic material, the method including contacting a lignocellulosic material with an ionic liquid to form a solution of the lignocellulosic material in the ionic liquid; adding an aqueous acidic solution to the solution of the lignocellulosic material in the ionic liquid to form an aqueous solution of sugar monomers and the ionic liquid; contacting the aqueous solution of sugar monomers and the ionic liquid with an aqueous alkaline solution to form a biphasic system which comprises an ionic liquid phase essentially free of sugar monomers and a second liquid phase comprising a monosaccharide; separating the ionic liquid phase and the second liquid phase; recovering the second liquid phase and subjecting the second liquid phase to neutralization and desalination. In some embodiments, the method further comprises using the neutralized, desalinated solution in a fermentation reaction, e.g., to produce ethanol.

The present invention may be used for producing sugars that can be used as a carbon source for a host cell to produce a biofuel or any useful organic compound. Examples of such products include, but are not limited to, alcohols (e.g., ethanol, methanol, butanol); organic acids (e.g., citric acid, acetic acid, itaconic acid, lactic acid, gluconic acid); ketones (e.g., acetone); amino acids (e.g., glutamic acid); gases (e.g., $H_2$ and $CO_2$); antibiotics (e.g., penicillin and tetracycline); enzymes; vitamins (e.g., riboflavin, B12, beta-carotene); fatty acids and fatty acid derivatives (as described, e.g., in PCT/US2008/068833); isoprenyl alkanoates (as described, e.g., PCT/US2008/068756, methyl butenol (as described, e.g., PCT/US2008/068831; fatty acid esters (as described, e.g., in PCT/US2010/033299), isoprenoid-based alternative diesel fuel (as described, e.g., in PCT/US2011/059784; a polyketide synthesized by a polyketide synthase, such as a diacid (see, e.g., PCT/US2011/061900), biofuels (see, e.g., PCT/US2009/042132) and alpha-olefins (see, e.g., PCT/US2011/053787).

Definitions

As used herein, the terms "monosaccharide", "sugar monomer" and the like refer to hydrolysis products of glucan, xylan, arabinan, galactan and mannan into their respective monomer components, i.e., glucose, xylose, arabinose, galactose and mannose, or a mixture thereof.

As used herein, the term "fermentable" with respect to a monosaccharide or sugar monomer refers to a soluble sugar monomer suitable for conversion into a fermentation product (e.g., ethanol) in a fermentation reaction.

As used herein, the term "essentially free of sugar monomers" with respect to a composition refers to a composition comprising no more than 10 wt %, more preferably 5 wt %, and most preferably 1 wt % sugar monomers.

Biomass

Biomass suitable for use in the process of the present invention include, but are not limited to, a cellulose biomass, a hemicellulose biomass, a lignocellulose biomass and mixtures thereof. In a one embodiment, the biomass is a lignocellulose biomass.

Lignocellulose-containing biomass primarily consisting of cellulose, hemicellulose, and lignin. Woody biomass, for instance, is about 45-50% cellulose, 20-25% hemicellulose and 20-25% lignin. Herbaceous materials have lower cellulose, lower lignin and higher hemicellulose contents. Cellulose biomass, hemicellulose biomass and lignocellulose biomass are generally referred to herein as "biomass."

Cellulose is a linear beta 1→4 linked polymer of glucose. It is the principal component of all higher plant cell walls. In nature, cellulose exists in crystalline and amorphous states. The thermodynamic stability of the beta 1→4 linkage and the capacity of cellulose to form internal hydrogen bonds gives it great structural strength. Cellulose is degraded to glucose through hydrolytic cleavage of the glycosidic bond.

Hemicellulose is a term used to refer to a wide variety of heteropolysaccharides found in association with cellulose and lignin in both woody and herbaceous plant species. The sugar composition varies with the plant species, but in angiosperms, the principal hemicellulosic sugar is xylose. Like cellulose, xylose occurs in the beta 1→4 linked backbone of the polymer. In gymnosperms, the principal component sugar is mannose. Arabinose is found as a side branch in some hemicelluloses.

Lignin is a phenylpropane polymer. Unlike cellulose and hemicellulose, lignin cannot be depolymerized by hydrolysis. Cleavage of the principal bonds in lignin require oxidation.

In one embodiment, the biomass is a lignocellulose-containing material (or, alternatively, lignocellulose biomass). In some embodiments, the lignocellulose-containing material contains at least 30 wt.-%, preferably at least 50 wt.-%, more preferably at least 70 wt.-%, even more preferably at least 90 wt.-% lignocellulose. It will be understood by those of skill that the lignocellulose-containing material can also comprise other constituents, such as proteinaceous material, starchy material, and sugars, such as fermentable sugars and/or un-fermentable sugars.

Lignocellulose biomass is generally found, for example, in the stems, leaves, hulls, husks, and cobs of plants or leaves, branches, and wood of trees. Lignocellulose biomass can also be, but is not limited to, herbaceous material, agricultural residues, forestry residues, municipal solid wastes, waste paper, and pulp and paper mill residues. It is to be understood that lignocellulose biomass may be in the form of plant cell wall material containing lignin, cellulose and hemicellulose in a mixed matrix.

In some embodiments, the lignocellulose biomass includes, but is not limited to, corn stover, corn fiber, hardwood, such as poplar and birch, softwood, cereal straw, such as, wheat straw, switchgrass, *Miscanthus*, rice hulls, or mixtures thereof. Other examples include corn fiber, rice straw, wheat bran, pine wood, wood chips, poplar, bagasse, paper and pulp processing waste.

The lignocellulosic material can any lignocellulosic material known to one of skill in the art, such as timber, logging waste, wood chips, grasses, waste agricultural material such as bagasse, corn husks, seed hulls, waste pulp and paper products, and the like. In some embodiments, the lignocellulosic material is physically or chemically treated or untreated. In other embodiments, the lignocellulosic material is switchgrass, corn stover or bagasse.

Ionic Liquid

Ionic liquids (ILs) are salts that are liquids rather than crystals at room temperatures. It will be readily apparent to those of skill that numerous ILs can be used in the pretreatment process of the present invention. In some embodiments of the invention, the IL is suitable for pretreatment of the biomass and for the hydrolysis of cellulose by thermostable cellulase. Suitable ILs are taught in ChemFiles (2006) 6(9) (which are commercially available from Sigma-Aldrich, Milwaukee, Wis.). Such suitable ILs include, but are not limited to, 1-alkyl-3-alkylimidazolium alkanate, 1-alkyl-3-alkylimidazolium alkylsulfate, 1-alkyl-3-alkylimidazolium methylsulfonate, 1-alkyl-3-alkylimidazolium hydrogensulfate, 1-alkyl-3-alkylimidazolium thiocyanate, and 1-alkyl-3-alkylimidazolium halide, wherein an "alkyl" is an alkyl group comprising from 1 to 10 carbon atoms, and an "alkanate" is an alkanate comprising from 1 to 10 carbon atoms. In some embodiments, the "alkyl" is an alkyl group comprising from 1 to 4 carbon atoms. In some embodiments, the "alkyl" is a methyl group, ethyl group or butyl group. In some embodiments, the "alkanate" is an alkanate comprising from 1 to 4 carbon atoms. In some embodiments, the "alkanate" is an acetate. In some embodiments, the halide is chloride.

In some embodiments, the IL includes, but is not limited to, 1-ethyl-3-methylimidazolium acetate (EMIN Acetate), l-ethyl-3-methylimidazolium chloride (EMIN CI), 1-ethyl-3-methylimidazolium hydrogensulfate (EMIM $HOSO_3$), 1-ethyl-3-methylimidazolium methylsulfate (EMIM $MeOSO_3$), 1-ethyl-3-methylimidazolium ethylsulfate (EMIM $EtOSO_3$), 1-ethyl-3-methylimidazolium methanesulfonate (EMIM $MeSO_3$), 1-ethyl-3-methylimidazolium tetrachloroaluminate (EMIM AICI4), 1-ethyl-3-methylimidazolium thiocyanate (EMIM SCN), 1-butyl-3-methylimidazolium acetate (BMIM Acetate), 1-butyl-3-methylimidazolium chloride (BMIM CI), 1-butyl-3-methylimidazolium hydrogensulfate (BMIM $HOSO_3$), 1-butyl-3-methylimidazolium methanesulfonate (BMIM $MeSO_3$), 1-butyl-3-methylimidazolium methylsulfate (BMIM $MeOSO_3$), 1-butyl-3-methylimidazolium tetrachloroaluminate (BMIM AICI4), 1-butyl-3-methylimidazolium thiocyanate (BMIM SCN), 1-ethyl-2,3-dimethylimidazolium ethylsulfate (EDIM $EtOSO_3$), Tris(2-hydroxyethyl)methylammonium methylsulfate (MTEOA $MeOSO_3$), 1-methylimidazolium chloride (MIM CI), 1-methylimidazolium hydrogensulfate (MIM $HOSO_3$), 1,2,4-trimethylpyrazolium methylsulfate, tributylmethylammonium methylsulfate, choline acetate, choline salicylate, and the like.

In some embodiments, the ionic liquid is a chloride ionic liquid. In other embodiments, the ionic liquid is an imidazolium salt. In still other embodiments, the ionic liquid is a 1-alkyl-3-imidazolium chloride, such as 1-ethyl-3-methylimidazolium chloride or 1-butyl-3-methylimidazolium chloride.

In some embodiments, the ionic liquids used in the invention are pyridinium salts, pyridazinium salts, pyrimidium salts, pyrazinium salts, imidazolium salts, pyrazolium salts, oxazolium salts, 1,2,3-triazolium salts, 1,2,4-triazolium salts, thiazolium salts, isoquinolium salts, quinolinium salts isoquinolinium salts, piperidinium salts and pyrrolidinium salts. Exemplary anions of the ionic liquid include, but are not limited to halogens (e.g., chloride, floride, bromide and iodide), pseudohalogens (e.g., azide and isocyanate), alkyl carboxylate, sulfonate, acetate and alkyl phosphate.

Additional ILs suitable for use in the present invention are described in U.S. Pat. No. 6,177,575 and U.S. Patent Application Publication No. 2010/0196967, which are herein incorporated by reference. It will be appreciated by those of skill in the art that others ILs that will be useful in the process of the present invention are currently being developed or will be developed in the future, and the present invention contemplates their future use.

The ionic liquid can comprises one or a mixture of the compounds.

In some embodiments, the step of contacting a lignocellulosic material with an ionic liquid is performed at a temperature of from about 100° C. to about 160° C. In other embodiments, the contacting with an ionic liquid step is performed for a period of about 1 hour to about 16 hours, or from a period of about 1 hour to about 12 hours, or from a period of about 1 hour to about 6 hours.

Acidic Hydrolysis

Suitable aqueous acidic solutions include, but are not limited to, hydrochloric acid, sulfuric acid and mixtures thereof. In some embodiments, the aqueous acidic solution is a hydrochloric acid solution. In other embodiments, the aqueous acidic solution has a concentration of about 2 M to about 12 M. In some embodiments, an aqueous acidic solution having a concentration of about 2 M to about 12 M is added to the solution of the lignocellulosic material in the ionic liquid. In other embodiments, an aqueous acidic solution having a concentration of about 2 M to about 12 M is formed by adding an aqueous acidic solution having a concentration greater than about 2 M to about 12 M and water independently to the solution of the lignocellulosic material in the ionic liquid to obtain an aqueous acidic solution having a concentration of about 2 M to about 12 M. In certain embodiments, an aqueous acidic solution having a concentration greater than about 2 M to about 12 M and water are added to the solution of the lignocellulosic material in the ionic liquid by aliquot. In certain other embodiments, an aqueous acidic solution having a concentration greater than about 2 M to about 12 M and water are continuously added to the solution of the lignocellulosic material in the ionic liquid via a pump or other means for continuous addition.

In some embodiments, the step of adding an aqueous acidic solution to the solution of the lignocellulosic material in the ionic liquid is performed at a temperature of from about 60° C. to about 110° C. In other embodiments, the adding step is performed for a period of from about 2 hours to about 6 hours.

Alkaline Extraction

Suitable aqueous alkaline solutions include hydroxide solutions, including, but not limited to, calcium hydroxide, potassium hydroxide, ammonium hydroxide, lithium hydroxide, magnesium hydroxide and sodium hydroxide and mixtures thereof. In some embodiments, the aqueous alkaline solution is a sodium hydroxide solution. In other embodiments, the aqueous alkaline solution has a pH of from about 8 to about 14. In some embodiments, the step of adding the aqueous alkaline solution is performed at a temperature ranging from about 20° C. to about 50° C. In some embodiments, the step of adding the aqueous alkaline solution is performed at a temperature ranging from about 20° C. to about 50° C.

Formation of the biphasic system can occur with or without shaking, mixing or other means for improving or enhancing contact of the aqueous solution of sugar monomers and the ionic liquid with the aqueous alkaline solution. In one embodiment, formation of the biphasic system occurs with shaking. In another embodiment, formation of the biphasic system occurs with mixing.

Separation of the ionic liquid phase and the second liquid phase can be performed or facilitated by a variety of liquid-liquid phase separation methods. Examples of separation methods include, but are not limited to, centrifugation, decantation, extraction with an organic solvent, and filtration. One of skill in the art will appreciate additional or alternative liquid-liquid separation methods that can be used.

Recovery, Isolation and Further Processing

In still other embodiments, the present invention provides a method for obtaining a monosaccharide from a lignocellulosic material, the method including contacting a lignocellulosic material with an ionic liquid to form a solution of the lignocellulosic material in the ionic liquid; adding an aqueous acidic solution to the solution of the lignocellulosic material in the ionic liquid to form an aqueous solution of sugar monomers and the ionic liquid; contacting the aqueous solution of sugar monomers and the ionic liquid with an aqueous alkaline solution to form a biphasic system which comprises an ionic liquid phase essentially free of sugar monomers and a second liquid phase comprising a monosaccharide; separating the ionic liquid phase and the second liquid phase; subjecting the second liquid phase to neutralization and desalination. The neutralized, desalinated second liquid phase may be used in a reaction, such as a fermentation reaction. In some embodiments, the method may comprise recovering the monosaccharide In some embodiments, the method may comprise recovering the monosaccharide. Accordingly, in another embodiment, the present invention provides a method for obtaining a fermentable monosaccharide from a lignocellulosic material, the method including contacting a lignocellulosic material with an ionic liquid to form a solution of the lignocellulosic material in the ionic liquid; adding an aqueous acidic solution to the solution of the lignocellulosic material in the ionic liquid to form an aqueous solution of sugar monomers and the ionic liquid; contacting the aqueous solution of sugar monomers and the ionic liquid with an aqueous alkaline solution to form a biphasic system which comprises an ionic liquid phase essentially free of sugar monomers and a second liquid phase comprising a fermentable monosaccharide; separating the ionic liquid phase and the second liquid phase; subjecting the second liquid phase to neutralization and desalination; and isolating a fermentable monosaccharide.

In further embodiments, the present invention provides a method for producing ethanol from a lignocellulosic material, the method including contacting a lignocellulosic material with an ionic liquid to form a solution of the lignocellulosic material in the ionic liquid; adding an aqueous acidic solution to the solution of the lignocellulosic material in the ionic liquid to form an aqueous solution of sugar monomers and the ionic liquid; contacting the aqueous solution of sugar monomers and the ionic liquid with an aqueous alkaline solution to form a biphasic system which comprises an ionic liquid phase essentially free of sugar monomers and a second liquid phase comprising a fermentable monosaccharide; separating the ionic liquid phase and the second liquid phase; subjecting the second liquid phase to neutralization and desalination; and subjecting the neutralized desalinated liquid to a fermentation reaction.

In some embodiments, following enzymatic hydrolysis, the fermentable sugars from the hydrolyzed biomass are fermented using one or more fermenting organisms capable of fermenting fermentable sugars, such as glucose, xylose, mannose, and galactose, directly or indirectly into a desired fermentation product. The fermentation conditions depend on the desired fermentation product and can easily be determined by one of ordinary skill in the art.

In some embodiments, the invention provides a composition where the composition is a liquid phase comprising soluble sugars where the liquid phase is obtained by a method of the invention as described herein.

Subsequent to fermentation, the fermentation product may optionally be separated from the fermentation medium in any suitable way. For instance, the medium may be distilled to extract the fermentation product or the fermentation product may be extracted from the fermentation medium by micro or membrane filtration techniques. Alternatively, the fermentation product may be recovered by stripping. Such recovery processes are well known in the art. The dry solids remaining after recovery comprising among other compounds lignin may be used in a boiler for steam and power production.

The present invention may be used for producing sugars to use as a carbon source of any reactions.

In one embodiment, the fermentation product is an alcohol, such as ethanol. The fermentation product, such as ethanol, obtained according to the invention, may be used as fuel alcohol/ethanol. However, in the case of ethanol, it may also be used as potable ethanol.

The present invention will be described in greater detail by way of specific examples. The following examples are offered for illustrative purposes, and are not intended to limit the invention in any manner. Those of skill in the art will readily recognize a variety of noncritical parameters which can be changed or modified to yield essentially the same results.

EXAMPLES

Switchgrass was received from University of California, Davis. The samples were ground in a Thomas-Wiley® Mill fitted with a 40-mesh screen (Model 3383-L10 Arthur H. Thomas Co., Philadelphia, Pa., USA) and sieved prior to use. Particle sizes of less than 60 mesh was used for all the experiments. Ionic liquids, 1-Ethyl-3-methylimidazolium chloride ([$C_2$mim]Cl, BASF, >95% purity) and 1-butyl-3-methylimidazolium chloride ([$C_4$mim]Cl, BASF, >95% purity) were purchased from Sigma-Aldrich. Standardized solutions of HCl (6N) and NaOH (50%, w/w) were purchased from VWR scientific. All other reagents and solvents were of analytical grade.

Example 1: Biomass Pretreatment and Acidolysis

Biomass solution was prepared by combining different amounts (0.5 g, 0.75 g, 1 g, and 1.5 g) of switchgrass with 10 g ionic liquid in a 80 mL medium bottle. The mixtures were heated and stirred in an oil bath at different conditions: 105° C. for 6 h or 160° C. for 1.5 h. All experiments were conducted in duplicates. Solutions were then placed into another oil bath which was already equilibrated at the acidolysis temperature of 105° C. and allowed to equilibrate for 15 min.

Acidolysis was performed similar to the procedure described before (Brennan et al. *BioEnergy Research,* 2010, 3, 123-133; Binder el al. *Proceedings of the National Academy of Sciences,* 2010, 107, 4516). 4 M HCl was then added to the solution (t=0) at concentrations of 100 mg HCl per g biomass and with DI water added to give a $H_2O$ concentration of 5% (w/w) of the total weight. More water was added at different time intervals (10 min, 20 min, 30 min, and 60 min) to result in targeted water concentrations of 20, 25, 33 and 43% (scheme 1). Continuous water addition was also attempted to compare the effect on sugar yields. Water was pumped into the mixture starting from either 10 or 15 min at the rate of 157.2 or 121.1 μL/min for 50 or 45 min. Acidolysis was continued for 2.5 h and was stopped by taking the bottle out of the oil bath with/without addition of extra amount of water (0, 7.5, or 15 mL). The mixture was transferred into centrifuge tubes and centrifuged at high speed (10,000 rpm) to separate the solid residue from the aqueous solutions, which contained sugar monomers. The solid residue was washed with 5×40 mL water and lyophilized for two days.

Figure 3:
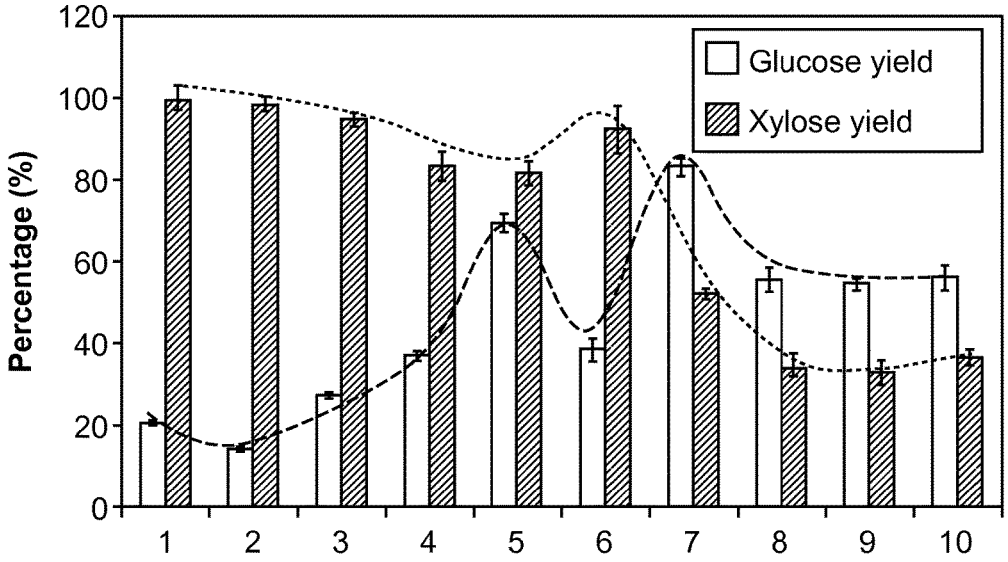
FIG. 3 shows glucose and xylose yield after the acidolysis of the switchgrass in IL. The number of the x-axis label corresponds to the run numbers in Table 1. (glucose, first column; xylose, second column)

Different pretreatment conditions were assessed, and the results are compared in FIG. 3. Detailed results are listed in Table 1. The pretreatment conditions were described in the literature (Binder et al. *Proceedings of the National Academy of Sciences,* 2010, 107, 4516) to be 105° C. for 6 h. We have previously tried 120° C. and 140° C. with the same pretreatment time (last hour to cool down to 105° C. for acidolysis) and found the sugar yields decreased (Brennan et al., submitted results). It was reported that "flash heating" (higher temperature and shorter time) is more efficient with regards to the carbohydrate yield and removal of lignin content (Li et al. *Green Chem.,* 2011, 13, 2038-2047). We have attempted 160° C. for different times (1 h and 1.5 h). With 1.5 h, the particles were not observed and the mixture turned into a homogenous dark solution. The sugar yields was calculated based on Eq 1:

$$\text{Yield } \% = \frac{C_{sup} \times TV_{sup}}{W_{sg} \times C_{sug} \times f} \times 100\% \quad (1)$$

where $TV_{sup}$ is the total volume of the supernatant, $C_{sup}$ is the sugar concentration of the supernatant before the addition of NaOH, $W_{sg}$ is the weight of the switchgrass pretreated by IL and $C_{sug}$ is the percentage of glucan/xylan contained in the switchgrass, and f is the factor to convert glucanixylan to glucose/xylose (1.11 for glucan and 1.136 for xylan). The results showed that the final dilution is not necessary since the glucose yield is improved by 35% with 37% more water in the system and xylose yields are similar. With increased temperature and decreased pretreatment time the glucose yield was greatly improved (20.7% vs. 69.4%). However, less xylose (100% vs. 82%) was obtained, possibly due to more xylose degradation at higher temperature. [$C_2$mim]Cl gives slightly higher glucose yield (69.4% vs. 77.8%) but lower xylose yield (81.9% vs. 68.8%) under the same conditions. Compared to the reported data, the glucose yields are lower with the 105° C./6 h pretreatment condition (Brennan et al., submitted results). This is due to the different scales, biomass particle sizes, water content of the biomass, etc., all of which are factors affecting the final yields.

TABLE 1

Glucose and xylose yields after the acidolysis of biomass in [$C_4$mim]Cl with different pretreatment conditions.[a]

| Run No. | Pretreatment Conditions | $H_2O$ Addition | Solid Residue (wt %) | Glucose Yield (%) | Xylose Yield (%) |
|---|---|---|---|---|---|
| 1 | 105° C. 6 h | Aliquot | 34.9 | 20.7 ± 0.4 | 99.8 ± 2.6 |
| 2[b] | 105° C. 6 h | Aliquot | 34.8 | 14.2 ± 0.3 | 98.6 ± 1.8 |
| 3[c] | 105° C. 6 h | Aliquot | 34.8 | 27.4 ± 0.7 | 95.4 ± 2.0 |

TABLE 1-continued

Glucose and xylose yields after the acidolysis of biomass in [$C_4$mim]Cl with different pretreatment conditions.[a]

| Run No. | Pretreatment Conditions | $H_2O$ Addition | Solid Residue (wt %) | Glucose Yield (%) | Xylose Yield (%) |
|---|---|---|---|---|---|
| 4 | 160° C. 1 h | Aliquot | 13.7 | 37.1 ± 1.2 | 83.4 ± 3.8 |
| 5 | 160° C. 1.5 h | Aliquot | 6.7 | 69.4 ± 2.5 | 81.9 ± 2.8 |
| 6 | 160° C. 1.5 h | Pumped @ 10 min | 13.8 | 38.6± | 92.6 ± 5.5 |
| 7 | 160° C. 1.5 h | Pumped @15 min | 10.2 | 83.3 ± 1.9 | 52.1 ± 1.2 |

[a]For all the runs, 0.5 g biomass was mixed with 10 g [$C_4$mim]Cl;
[b]7.5 mL water was added at the end of the acidolysis;
[c]15 mL water was added at the end of the acidolysis.

In previous reports (Binder et al. *Proceedings of the National Academy of Sciences,* 2010, 107, 4516), water was added at different time intervals to achieve high sugar yields. We used a syringe pump and consciously pumped water into the system and compared the results (Run 6). Our results indicated that the glucose yields and xylose yields seemed to be competing. This is expected because xylan is much easier to be dissolved or hydrolyzed compared to glucan. With harsh conditions, more glucan can be broken down while resulting in xylan xylose degradation.

Higher solid loadings were employed and the results are listed in Table 2. Although more solid residue (absolute mass) was left after the process and the glucose/xylose yields decrease, the final glucose/xylose concentration (calculated based on Eq 2) in the system actually increases.

$$\text{Final[glu] or [xyl]}=C_{sl}\times C_{sug}\times Y_{sug}\times 100\% \quad (2)$$

where $C_{sl}$ is the biomass solid loading and $Y_{sug}$ is the glucose or xylose yield. The accommodation of high solid loadings with this process is the high pretreatment temperature. The mixture was thick at the beginning and was not able to be stirred by the magnetic stir bar. The viscosity slowly decreased and stir bar was back to work in the middle of the pretreatment.

TABLE 2

Glucose and xylose yields after the acidolysis of biomass in [$C_4$mim]Cl with different solid loadings[a]

| Run No. | Solid Loading[b] (w/w) | Solid Residue (wt %) | Glucose Yield (%) | Xylose Yield (%) | Final [Glc] (g/L) | Final [Xyl] (g/L) |
|---|---|---|---|---|---|---|
| 7 | 5 | 10.2 | 83.3 ± 1.9 | 52.1 ± 1.2 | 8.0 ± 0.2 | 3.4 ± 0.1 |
| 8 | 7.5 | 9.7 | 55.5 ± 3.0 | 34.1 ± 2.0 | 8.3 ± 0.4 | 3.5 ± 0.2 |
| 9 | 10 | 9.4 | 54.4 ± 1.6 | 32.9 ± 2.8 | 10.2 ± 0.3 | 6.7 ± 0.4 |
| 10 | 15 | 8.0 | 56.2 ± 3.1 | 36.7 ± 1.9 | 15.5 ± 0.8 | 6.9 ± 0.4 |

[a]water was pumped into the system 15 min after the pretreatment.
[b]solid loading is the ratio of the mass of SG to mass of IL.

Example 2: Extraction of Sugars Using Alkaline Solution

Extraction of standard sugars. 33 mg glucose and 21 mg xylose (simulate 0.1 g biomass) was dissolved in an IL and water mixture (2 g IL+1.5 g $H_2O$) in a 15 mL centrifuge tube. 70 μL 4 M HCl was added to the mixture and mixed in an incubator at 30° C. and 1400 rpm for 30 min. 1 mL mixture solution was placed in to a 2 mL eppendorf tube and different amounts (ca. 130 or 200 μL) of concentrated NaOH (50% w/w) was added to make the final NaOH concentration 15 or 20 wt % (considering the water in the system). The mixture was agitated in a thermomixer at RT and 1400 rpm for 0.5 h and then centrifuged at high speed (14,000 rpm) to phase separate. The upper IL phase and lower NaOH phase was separated with a pipette and the sugar content was quantified. The volume of the upper and lower phase is calculated by measuring the mass and density of both phases.

As shown in FIG. 1, clear phase separation was obtained with addition of 2 mL 15% NaOH to 2 g IL ([$C_2$mim]Cl or [$C_4$mim]Cl). According to the literature, sugars are chaotropes and can induce phase separation with hydrophilic IL itself (Wu el al. *J. Phys. Chem. B* 112 (2008) 6426). We determined that sugars could be used to separate sugars from IL aqueous solution. Without sugar or any biomass 10 wt % NaOH can phase separate with the two ILs. However, upon addition of biomass no clear phase separate can be observed with final NaOH concentration 15 wt %. Therefore, 15 wt % NaOH was used for these examples.

Figure 2:
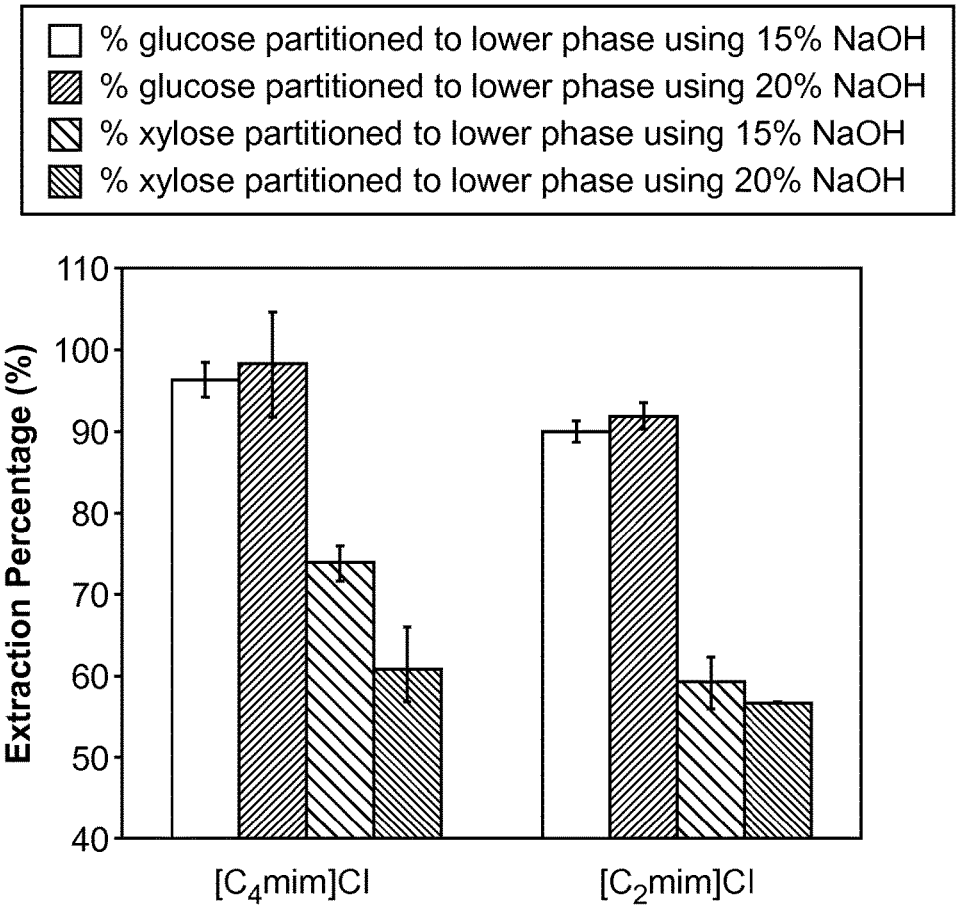
FIG. 2 shows the percentage of glucose and xylose partitioned to the lower salt rich phase using two different NaOH concentrations. (% glucose using 15% NaOH, first column; % glucose using 20% NaOH, second column; % xylose using 15% NaOH, third column; % xylose using 20% NaOH, fourth column)

The system was firstly applied with the sugar standards. Mixture of glucose (0.33 g) and xylose (0.21 g) was added to ILs aqueous solution (2 g IL+1.5 g $H_2O$, ratio of biomass to IL is equivalent to 5 wt %). To mimic the acid hydrolysis, certain amount of HCl was added to the mixture. After the dissolution, calculated amount of 50 wt % NaOH was added to the mixture. Considering the water present in the system, the final concentration of NaOH in the system is either 15 wt % or 20 wt %. The results are shown in FIG. 2. The results are the percentage of the sugars in the IL aqueous solution before phase separation using Eq. 3:

$$\text{Extraction \%} = \frac{C_{low}\times V_{low}}{C_{sup}\times V_{sup}}\times 100\% \quad (3)$$

where $C_{low}$ is the sugar concentration of the lower salt-rich phase, $V_{low}$ is the volume of the salt-rich phase, $C_{sup}$ is the sugar concentration of the supernatant before the addition of NaOH, and $V_{sup}$ is the volume of the supernatant used for phase separation which is 1 mL. More glucose has been extracted to the bottom phase in comparison to xylose. For the upper IL phase less than 1% glucose or xylose can be detected. The lower phase needed to be diluted 3000× in order to be quantified by HPAEC; however, the upper phase was only diluted to 5×. The system worked better using [$C_4$mim]Cl with slightly better extractions for both glucose and xylose ([$C_4$mim]Cl 15% NaOH: 96.5% for glucose, 73.9% for xylose; [$C_2$mim]Cl 15% NaOH: 90.1% for glucose, 59.2% for xylose). With higher concentration of NaOH the amount of glucose partitioned to the lower phase is higher ([$C_4$mim]Cl: 96.5% vs. 98.3%; [$C_2$mim]Cl: 90.1% vs. 92.0%), while the amount of xylose in the lower phase goes down ([$C_4$mim]Cl: 73.9% vs. 60.9%; [$C_2$mim]Cl: 59.2% vs. 56.7%), we hypothesized that it is due to the degradation of the xylose in basic conditions. Based on the results with standard sugars, [$C_4$mim]Cl/15% NaOH system was mostly used in the following experiments on biomass process.

Extraction of Acidolysis Sugars.

The procedure is similar to the extraction of standard sugars except that only 15 wt % NaOH (final concentration) was used based on the results from the standard sugars. The total volume of the supernatant was calculated based on the total mass and density of the supernatant after separation of the solid residue.

Figure 4:
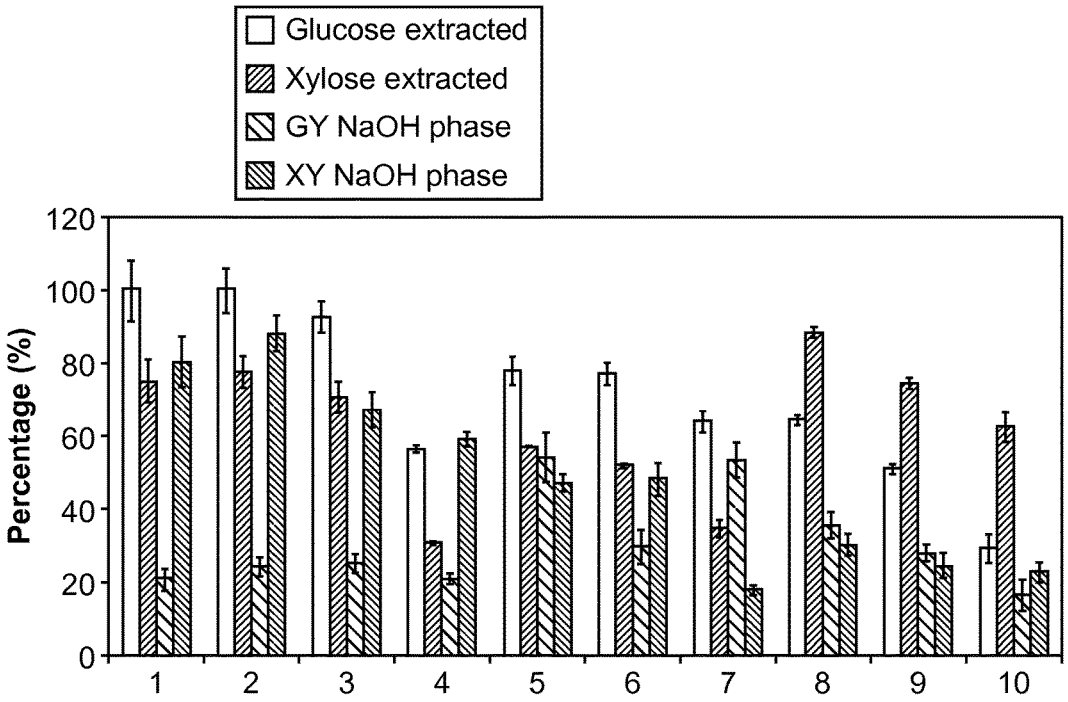
FIG. 4 shows the percentage of glucose and xylose partitioned to the salt-rich phase (glucose, first column; xylose, second column) and final sugar yields in the alkali phase (glucose, third column; xylose, fourth column). The number of the x-axis label corresponds to the run numbers in Table 1.
Figure 5:
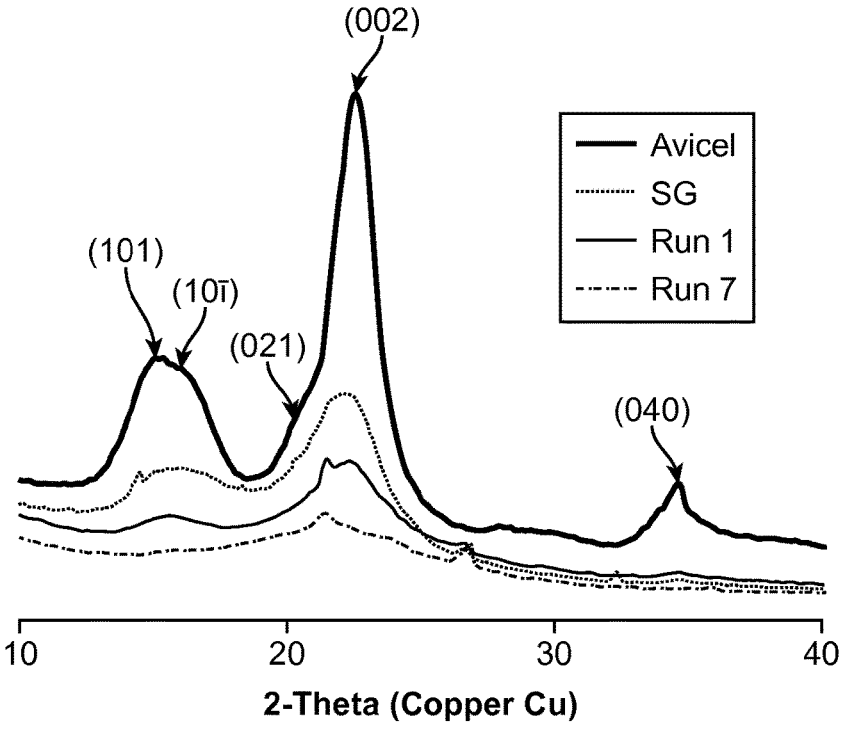
FIG. 5 shows diffractograms of the biomass before and after the process. Red, Avicel, Green, switchgrass, Blue: solid residue from run 1. Purple: solid residue from run 5. CrI of Avicel: 0.74, SG: 0.38, Run 1: 0.29, Run 5: 0.08. (top line, Avicel; second line. SG; third line, Run 1; bottom line, Run 7; referenced to "10" on the x-axis).

After the acidolysis step, the supernatant was separated from the biomass solid residue by centrifugation. 1 mL supernatant was loaded in the eppendorf tubes and calculated amount of concentrated NaOH was added into the tubes. After the vigorous mixing, the mixture was centrifuged and clear phase separation was observed as shown in FIG. 1*b*. The sugar extraction was calculated based on the sugars present in the supernatant before the phase separation (Eq. 1) and the results are listed in FIG. 4 and Table 3. Overall, more glucose partitioned to the lower phase compared to xylose. With higher glucose yields from the acid hydrolysis less has partitioned to the lower phase, which indicates that there is a maximum amount of sugars that can partition to the salt rich phase. After the extraction, less than 2% of the acidolysis sugars are left in the IL phase. The final sugar yields in the last two columns of Table 3 represent how much sugars were retained in the lower salt-rich phase and calculated based on Eq. 4.

$$\text{Final[glu] or [xyl] yield}=Y_{sug}\times E_{sug}\times 100\% \quad (4)$$

TABLE 3

Partition of the sugars after phase separation

| Run No. | $[Glc]_{IL}$ (g/L)[a] | $[Glc]_{NaOH}$ (g/L) | Log $P_{glc}$ | $[Xyl]_{IL}$ (g/L)[a] | $[Xyl]_{NaOH}$ (g/L) | Log $P_{xyl}$ | $GY_{NaOH}$ (%)[b] | $XY_{NaOH}$ (%)[b] |
|---|---|---|---|---|---|---|---|---|
| 1 | 0.004 | 8.55 ± 0.65 | 3.33 | ND | 18.58 ± 1.50 | — | 22.64 | 80.33 |
| 2 | 0.002 | 2.31 ± 0.13 | 3.06 | ND | 7.47 ± 0.41 | — | 15.60 | 88.26 |
| 3 | 0.001 | 2.46 ± 0.11 | 3.39 | 0.002 | 3.62 ± 0.24 | 3.26 | 25.26 | 67.19 |
| 4 | 0.007 | 8.84 ± 0.13 | 3.10 | 0.003 | 5.71 ± 0.10 | 3.28 | 20.98 | 59.05 |
| 5 | 0.016 | 17.84 ± 0.27 | 3.05 | 0.005 | 8.24 ± 0.05 | 3.22 | 54.23 | 47.01 |
| 6 | 0.008 | 10.07 ± 0.17 | 3.10 | 0.005 | 8.10 ± 0.17 | 3.21 | 29.81 | 48.15 |
| 7 | 0.018 | 24.73 ± 1.39 | 3.14 | 0.006 | 7.00 ± 0.65 | 3.07 | 53.42 | 18.07 |
| 8 | 0.020 | 26.56 ± 0.28 | 3.12 | 0.040 | 15.20 ± 0.49 | 2.58 | 35.72 | 30.23 |
| 9 | 0.023 | 28.06 ± 0.26 | 3.09 | 0.041 | 26.91 ± 0.42 | 2.82 | 27.82 | 24.46 |
| 10 | 0.036 | 32.94 ± 2.86 | 2.96 | 0.057 | 30.86 ± 3.19 | 2.73 | 16.57 | 22.91 |

Note:
$[Glc]_{IL}$ or $[Xyl]_{IL}$ is glucose or xylose concentration in the IL phase; $[Glc]_{NaOH}$ or $[Xyl]_{NaOH}$ is glucose/xylose concentration in NaOH phase; ND: not detected.
[a]The standard deviation is within 20% of the measurement. The deviation is due to the low concentration of the sugars in IL phase and detection limit of the instrument.
[b]$GY_{NaOH}$ is the final glucose yield in NaOH phase (percentage of the glucose in original biomass); $XY_{NaOH}$ is the final xylose yield in NaOH phase (percentage of the xylose in original biomass).

where $E_{sug}$ is the extraction percentage calculated based on Eq. 1 (column 3 and 4 in Table 2). Overall, up to 54% of the glucose and 88% of xylose in original switchgrass can be released and then extracted to the salt rich phase (different pretreatment conditions are required depending on whether C5 or C6 is the focus). With more glucose recovered, less xylose can be obtained. Since only very limited amount of sugars were detected in the IL phase, 50% of the sugars were lost after the process under the optimized conditions (Run 5).

Considerable amount of sugar loss may be due to the degradation of the monomers to other small molecules. Glucose and xylose could be dehydrated to furans and other degradation products. 5-hydroxylmethylfurfural (HMF) and furfural were quantified for the supernatant as well as the upper and lower phase after the phase separation and the results are listed in Table 4. The results show that only up to 5% of the glucose (equivalent) was converted to HMF after the acidolysis. Relatively more xylose (5-11%) was dehydrated to furfural. However, neither furfural nor HMF can be detected in the two phases with the addition of concentrated NaOH, preventing the inhibition of the downstream fermentation. This also indicates that HMF and furfural has been converted to other molecules with the addition of caustic alkali solution.

TABLE 4

Quantification of the HMF and furfural in the system

| Run No. | % Glu to HMF | % Xyl. to Furfural |
|---|---|---|
| 1 | 2.16 ± 0.00 | 6.07 ± 0.01 |
| 2 | 1.79 ± 0.01 | 6.05 ± 0.02 |
| 3 | 2.05 ± 0.01 | 5.63 ± 0.02 |
| 4 | 2.95 ± 0.01 | 5.88 ± 0.01 |
| 5 | 4.79 ± 0.06 | 8.52 ± 0.02 |
| 6 | 3.25 ± 0.03 | 9.01 ± 0.02 |
| 7 | 5.14 ± 0.02 | 10.93 ± 0.00 |
| 8 | 3.66 ± 0.02 | 4.66 ± 0.04 |
| 9 | 3.20 ± 0.00 | 6.23 ± 0.01 |
| 10 | 4.53 ± 0.00 | 9.35 ± 0.07 |

The IL content was quantified in the lower salt rich phase and the results are listed in Table 5. The percentage of the IL migrated to the lower phase is dependent on the pretreatment conditions. With the higher temperature and shorter time pretreatment (Run 4-7) less than 1% of the IL in the supernatant was partitioned to the lower salt rich phase. Comparatively, 4-9% partitioned to the lower phase for runs 1-3 with lower temperature and longer pretreatment time. The highest IL content was found in the lower salt rich phase with 15 mL water dilution at the end of the acidolysis. This is explainable since more water is expected in the lower phase. NMR analysis also shows that the IL in the upper phase resembles the original IL, while no IL signal can be detected in the lower salt rich phase.

TABLE 5

Quantification of the IL in the lower alkaline-rich phase

| Run | Dilution (mL) | $[C_4mim]Cl$ in alkali phase (mM) | % of IL to the alkaline phase |
|---|---|---|---|
| 1 | 0 | 784.5 | 5.8 |
| 2 | 1.5 | 302.6 | 5.9 |
| 3 | 3 | 317.0 | 9.4 |
| 4 | 0 | 75.2 | 0.6 |
| 5 | 0 | 63.5 | 0.4 |
| 6 | 0 | 70.6 | 0.5 |
| 7 | 0 | 39.9 | 0.3 |
| 8 | 0 | 97.2 | 0.6 |
| 9 | 0 | 90.3 | 0.5 |
| 10 | 0 | 86.1 | 0.4 |

Example 3: Analysis and Characterization

All aqueous solutions were analyzed for sugars using High Performance Anion Exchange Chromatography with Pulsed Amperometric Detection (HPAEC-PAD) on a Dionex ICS 3000 equipped with a Dionex CarboPac PA-20 analytical column (3×150 mm), according to procedures described previously (Brennan el al. *BioEnergy Research,* 2010, 3, 123-133). Elution was initiated with 89% (v/v) water and 11% (v/v) 1 M NaOH for the first 13.5 min, with 10 μL injection volume and 0.4 mL/imin for the flow rate. A 5 min gradient was applied and elute concentration was then switched to 55% (v/v) water and 45% (v/v) 100 mM NaOH until 30 min. The sugar standards including fucose, arabinose, rhamnose, galactose, glucose, xylose, fructose, and cellubiose used as the external standards for HPAEC were obtained from Sigma-Aldrich and Alfa Aesar, and prepared at levels of 6.25 to 100 μM before use.

Furfural was analyzed using agilent liquid chromatography equipped with Aminex HPX-87 H column and a UV detector (280 nm wave length for DAD). 4 mM $H_2SO_4$ was used as eluent and the flow rate was 0.6 mL/min. Standard curve was made by using 6 different concentrations of furfural (125-1000 μM) from Sigma-Aldrich. Ionic liquid was quantified using reversed phase liquid chromatography using an HPLC equipped with Eclipse Plus C8 column and Evaporative Light Scattering Detector (ELSD, evaporator temperature=45° C., nebulizer temperature=30° C.; gas flow=1.2). All analyses were performed at 0.5 mL/min flow rate. The injection volume was 5 μL and the column temperature was 30° C.

XRD data were collected with a PANalytical Empyrean X-ray diffractometer equipped with a PIXcel$^{3D}$ detector and operated at 45 kV and 40 kA using Cu Kα radiation (λ=1.5418 Å). The patterns were collected in the 2θ range of 5 to 55°, the step size was 0.026°, and the exposure time was 300 seconds. A reflection-transmission spinner was used as a sample holder and the spinning rate was set at 8 rpm throughout the experiment. The crystallinity index (CrI) was determined from the crystalline and amorphous peak areas by a curve fitting procedure of the measured diffraction patterns using the software package HighScore Plus®.

As described above, small quantity of solid is still left after the acidolysis process. The solid residue was separated by centrifugation, washed with DI water and then freeze dried. This solid residue is expected to be the most recalcitrant part of the plant cell wall and different analytical techniques were used to characterize the solid residue in order to gain more information on the process.

Only cellulose is crystalline in biomass and hemicelluloses and lignin are all amorphous. Crystalline cellulose is characterized by long-range order of polymeric chains connected via periodic hydrogen bonding (Nishiyama el al. *J. Am. Chem. Soc.,* 2003, 125, 14300-14306), while amorphous cellulose is composed of smaller chain segments held together in random noncrystalline domains (Ciolacu et al. *Cellulose Chem. Technol.,* 2011, 45, 13-21). PXRD was used to determine the proportions of crystalline (highly ordered) and disordered components (amorphous cellulose, hemicelluloses and lignin) present in biomass samples and to monitor the structural changes upon IL treatment. Commercial Avicel was analyzed as cellulose standard to validate the results. In general, the solid residue recovered after the IL treatment has reduced degrees of crystallinity compared to the untreated switchgrass. The observed PXRD patterns are dependent on the pretreatment conditions. With the lower temperature pretreatment (run 1), cellulose in the solid residue displays a structure similar to that of the original biomass (cellulose I). In addition to cellulose I peaks (15-16° for 101 and 10$\bar{1}$, 220 for 002), a shoulder around 21.5° is also observed, suggesting at least partial conversion to cellulose II. Overall, the calculated CrI shows a decrease from 0.38 to 0.29. In contrast, the biomass pretreatment at higher temperature results in disappearance of the broad peak at ca. 15-16°, which represents a combination of the 101 and 10$\bar{1}$ planes of cellulose I. The material is highly amorphous with a minor crystalline component (CrI=0.08). The broad peak around 21.4° may be assigned to the 002 cellulose II lattice plane. This indicates that the solvent IL has penetrated inside the solid part and disrupted the crystal structure of cellulose during the higher temperature pretreatment. For the sample pretreated at lower temperature, the PXRD pattern indicates that amorphization and a partial conversion to cellulose II occur simultaneously. This may explain why higher temperature/shorter time pretreatment is more efficient in solubilizing the biomass, thus resulting in more sugar production. Another possible explanation for the observed structural change is that the relative ratio of the three major biomass components is altered as a result of the pretreatment. Decrease of the cellulose content itself through hydrolysis/depolymerization may also result in reduced crystallinity.

Figure 6:
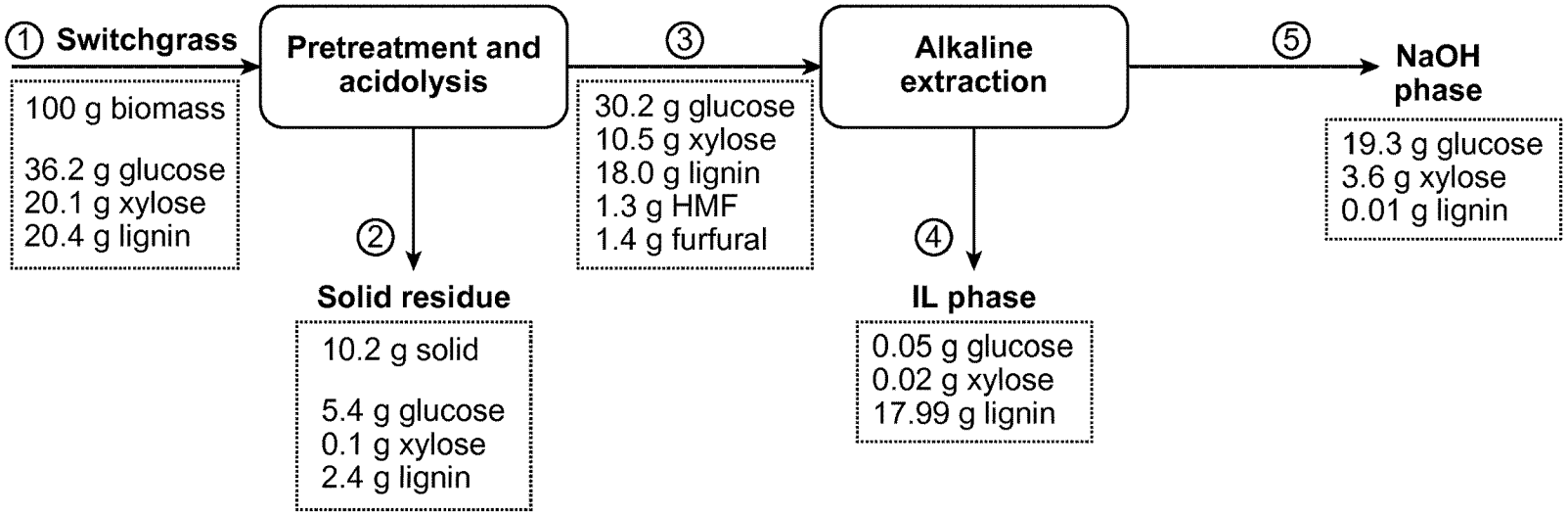
FIG. 6 shows representative mass balance of lignocellulose as defined by the process conditions used in Run 7. Lignin/sugars in the solid samples (stream 1 and 2) were quantified using the standard method; lignin in NaOH phase (stream 5) was quantified gravimetrically by adjusting the pH of the solution to pH=2-3 using 4 N HCl; lignin in stream 3 and 4 was calculated by subtraction; sugars in the liquid stream (3-5) were quantified using HPAEC.

A mass balance for Run 7 is shown in FIG. 6, and it should be noted that less xylose is observed in the NaOH phase, and that a significant amount of the lignin remains in the IL phase and would need to be removed in order to recycle the IL.

In order to obtain more chemical information, the solid residue was analyzed with 2D NRM and the spectra evaluated. It has been shown that a mixture of perdeuterated DMSO/pyridine (4:1, v/v) is a better solvent compared to DMSO-d6 only with regards to sample handling as well as the resolution and intensities of NMR spectra (Kim et al. *Org. Biomol. Chem.,* 2010, 8, 576-591). Thus mixture of perdeuterated DMSO/pyridine (4:1, v/v) was chosen as the solvent. The milled fine biomass powder was dissolved/swelled in the solvent with sonication at 50° C. for approximately 8 h (discontinuously). Aromatic region (4.0-5.5/102-150 ppm) of the 2D HSQC spectra provided information of p-hydroxyphenyl:guaiacyl:syringyl (H:G:S) distributions in the lignin. According to the spectra, the switchgrass lignin was dominated by G lignin with trace of H and S units. The correlation of S2/6 (6.78/104.02) and H 2/6 (7.24/127.8; 7.27/128.93) was very low intensity and could only be seen at low contour level. The C/H correlations from the G aromatic rings (G2, G5 and G6) were well resolved for both samples except that G5 (6.88/115.55) was overlapping with ferulate (FA) and p-coumarate (pCA): FA8+PCA8 (6.58/113.83). Ferulates and p-coumarates, attached primarily to arabinoxylans, are readily seen in grass samples (Kim et al. *J. Org. Biomol. Chem.* 2010, 8, 576-591, Lam et al. *Phytochemistry* 2001, 57, 987-992). The peak at 7.39/111.03 is assigned to FA2, and FA6 appears at 7.16/123.20 which is overlapping with the solvent peak (pyridine). After the process the signals decreased and FA6 can be only observed with low contour level. The pCA2/6 correlations are well resolved at 7.58/130.09 and pCA3/5 position is not resolved from G5 units. FA 7 and FA8 correlations coincide with pCA7 and pCA8 respectively at positions 7.67/145.08 and 6.58/113.83 pm. Integrals from well resolved 2,6-positions of each type of lignin can be used to calculate the H:G:S ratio. All types of lignin signals were weakened after the process. The S/G ratio decreased from 0.32 to 0.21 after the processing. The anomeric regions (4-5.5/90-105 ppm) indicates that xylan has been mostly removed with the disappearance of the peaks at 4.60/99.47 and 4.39/101.77 ppm which corresponds to xylan acetate (2-O—Ac-β-D-Xylp) and xylan [(1→4)-α-D-Glcp]. The intensities of the peaks for cellulose reducing ends [Glc(R), 5.08/92.27 & 4.46/96.98] have been greatly enhanced in the solid residue sample indicating lower degree of polymerization (DP) after the process.

Overall, the characterization results showed that the solid residue has undergone great compositional and chemical change after the process with comparison to the original biomass. Most xylan has been removed. Lignin and cellulose has been left with modified structures. 2D NMR shows detailed bonding structures. However, the dissolution of the samples in the solvent mixture was not complete, making it limited to represent the whole samples.

The invention has been described by way of illustration, and not by limitation. It is to be understood that the particular embodiments depicted in the figures and the terminology which has been used has been intended in a nature of words of description rather than of limitation. It is to be further understood that any combination of the ingredients/therapeutic agents described in the foregoing paragraphs are deemed to be encompassed by the appended claims. It is to be further understood that all specific embodiments of the injection device are deemed to be encompassed by the appended claims. Many modifications and variations of the present invention are possible in light of the above teachings. It is therefore to be understood that the obvious modifications are deemed to be encompass within the appended claims. The disclosures of all articles and references, including patent applications, patents, PCT publications, and accession numbers, are incorporated herein by reference for all purposes.

What is claimed is:

1. A method for obtaining sugar monomers from a lignocellulosic material, comprising:

(i) contacting a lignocellulosic material with an ionic liquid to form a solution of the lignocellulosic material in the ionic liquid, wherein the ionic liquid is an imidazolium salt, and adding an aqueous acidic solution to the solution lignocellulosic material in the ionic liquid to form by acidolysis an aqueous solution comprising sugar monomers and the ionic liquid;

(ii) preparing a biphasic system, wherein the step of preparing the biphasic system consists of contacting the aqueous solution of sugar monomers and the ionic liquid of (i) with an aqueous hydroxide solution to form a biphasic system which comprises a first phase and a second phase, wherein the final concentration of hydroxide is at least about 15 wt % based on the total weight of biphasic system, wherein the first phase is an aqueous ionic liquid phase which is essentially free of sugar monomers, and wherein the second phase is an aqueous liquid phase comprising sugar monomers;

(iii) separating the first phase and the second phase of the biphasic system of (ii), thereby separating the sugar monomers from the ionic liquid; and (iv) recovering the sugar monomers from the second phase obtained in step (iii).

2. The method of claim 1, wherein the lignocellulosic material is untreated.

3. The method of claim 2, wherein the lignocellulosic material is selected from the group consisting of switchgrass, corn stover and bagasse.

4. The method of claim 1, wherein the imidazolium salt is a chloride salt.

5. The method of claim 1, wherein step (iii) is conducted by decantation.

6. The method of claim 1, wherein the ionic liquid is selected from the group consisting of 1-ethyl-3-methylimidazolium chloride and 1-butyl-3-methylimidazolium chloride.

7. The method of claim 1, wherein the contacting the lignocellulosic material with the ionic liquid to form a solution of the lignocellulosic material in the ionic liquid is performed at a temperature of from about 100° C. to about 160° C.

8. The method of claim 1, wherein the contacting the lignocellulosic material with the ionic liquid to form a solution of the lignocellulosic material in the ionic liquid is performed for a period of about 1 hour to about 16 hours.

9. The method of claim 1, wherein the aqueous acidic solution is a hydrochloric acid solution.

10. The method of claim 1, wherein the concentration of the aqueous acidic solution prior to step (i) is about 2 M to about 12 M.

11. The method of claim 10, wherein the final concentration of the hydroxide is from about 15% w/w to 50% w/w based on the total weight of biphasic system.

12. The method of claim 1, wherein adding the aqueous acidic solution is performed at a temperature of from about 60° C. to about 110° C.

13. The method of claim 1, wherein the adding is performed for a period of from about 2 hours to about 6 hours.

14. The method of claim 1, wherein the hydroxide is selected from the group consisting of calcium hydroxide, ammonium hydroxide, potassium hydroxide, sodium hydroxide and lithium hydroxide.

15. The method of claim 14, wherein the hydroxide is sodium hydroxide.

16. The method of claim 1, wherein the contacting with the aqueous hydroxide solution is performed at a temperature of from about 20° C. to about 50° C.

17. The method of claim 1, wherein the contacting with the aqueous hydroxide solution is performed for a period of about 15 minutes to about 1 hour.

18. The method of claim 1, wherein the density of the second phase is from about 1.2 gram/$cm^3$ to about 1.4 gram/$cm^3$.

19. The method of claim 1, wherein the concentration of the sugar monomers in the second phase is from about 2 g/L to about 40 g/L.

20. The method of claim 1, wherein the sugar monomers are selected from the group consisting of glucose, xylose and mixtures thereof.

21. The method of claim 1, further comprising recovering and reusing the ionic liquid.

22. The method of claim 1, wherein the water content of the first phase is from about 20 wt % to about 50 wt %.

23. The method of claim 1, wherein the concentration of the aqueous acidic solution prior to step (i) is about 2 M to about 12 M.

24. The method of claim 1, wherein the ionic liquid is an imidazolium salt, the aqueous hydroxide solution is sodium hydroxide, and the final concentration of sodium hydroxide added in (ii) is about 15 wt % based on the total weight of biphasic system.

25. A method for obtaining fermentable sugar monomers from a lignocellulosic material, comprising:

(i) contacting a lignocellulosic material with an ionic liquid to form a solution of the lignocellulosic material in the ionic liquid, wherein the ionic liquid is an imidazolium salt; and adding an aqueous acidic solution to the solution of the lignocellulosic material in the ionic liquid to form by acidolysis an aqueous solution comprising sugar monomers and the ionic liquid, wherein the aqueous acidic solution is a hydrochloric acid solution, a sulfuric acid solution, or a mixture thereof;

(ii) preparing a biphasic system, wherein the method of preparing the biphasic liquid consists of contacting the aqueous solution of sugar monomers and the ionic liquid of (i) with an aqueous hydroxide solution to form a biphasic system which comprises a first phase and a second phase, wherein the final concentration of hydroxide is at least about 15 wt % based on the total weight of biphasic system, wherein the first phase is an aqueous ionic liquid phase which is essentially free of sugar monomers, and wherein the second phase is an aqueous phase comprising sugar monomers;

(iii) separating first phase and the second phase of the biphasic system of (ii), thereby separating the sugar monomers from the ionic liquid; and (iv) subjecting the second phase obtained in step (iii) to neutralization and desalination.

* * * * *